US008532550B2

(12) United States Patent
Arakawa

(10) Patent No.: US 8,532,550 B2
(45) Date of Patent: Sep. 10, 2013

(54) FUSING UNIT FOR STABLE SMALL-SHEET FEEDING IN IMAGE FORMING APPARATUS

(75) Inventor: Osamu Arakawa, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 182 days.

(21) Appl. No.: 13/241,310

(22) Filed: Sep. 23, 2011

(65) Prior Publication Data

US 2012/0251203 A1 Oct. 4, 2012

(30) Foreign Application Priority Data

Nov. 2, 2010 (JP) ..... 2010-246023

(51) Int. Cl.
*G03G 15/20* (2006.01)

(52) U.S. Cl.
USPC ..... 399/323

(58) Field of Classification Search
USPC ..... 399/323, 398, 399, 405; 271/307, 271/311, 900
See application file for complete search history.

(56) References Cited

U.S. PATENT DOCUMENTS 7,613,421 B2 * 11/2009 Kanematsu et al. ..... 399/323
7,684,744 B2 * 3/2010 Uchida ..... 399/323

FOREIGN PATENT DOCUMENTS

| | | | |
|---|---|---|---|
| JP | 05281872 A | * | 10/1993 |
| JP | 2004126222 A | * | 4/2004 |
| JP | 2005257992 A | * | 9/2005 |
| JP | 2005-292390 A | | 10/2005 |
| JP | 2006-189688 A | | 7/2006 |
| JP | 2010-026379 A | | 2/2010 |

* cited by examiner

*Primary Examiner* — Robert Beatty
(74) *Attorney, Agent, or Firm* — Keating & Bennett, LLP

(57) ABSTRACT

A fusing unit includes a heat roller and a press roller, which fuse a toner image fused to a recording sheet; a first separating pawl contacting a circumferential surface of the heat roller and separating the recording sheet from the heat roller; second separating pawls that are spaced from the first separating pawl in an axial direction to contact the circumferential surface of the heat roller and separate the recording sheet from the heat roller; a first rotatable guide in the first separating pawl that guides the recording sheet to a sheet discharge guide of an exit feed path while changing its orientation; a second rotatable guide provided in each of the second separating pawls which guides the recording sheet to a sheet discharge guide of an exit feed path while changing an orientation of the recording sheet; and a fusing feed path that reaches the sheet discharge guide.

8 Claims, 8 Drawing Sheets

FUSING UNIT FOR STABLE SMALL-SHEET FEEDING IN IMAGE FORMING APPARATUS

This application claims priority under 35 U.S.C. 119 to Japanese Patent Application No. 2010-246023, filed on Nov. 2, 2010, which application is hereby incorporated by reference in its entirety.

BACKGROUND OF THE INVENTION

1. Field of the Invention

The present invention relates to a fusing unit for an image forming apparatus such as a copying machine, a facsimile machine, or a printer, for example, and more particularly to an improvement of a structure of a separating pawl that forcedly separates a sheet from a circumferential surface of a heat roller.

2. Description of the Related Art

In a fusing unit of an image forming apparatus of the related art, the separating pawls are disposed at six points in a circumferential surface of a heat roller. The six separating pawls are constructed by three groups of pairs of separating pawls. In the first group, the separating pawls are disposed at two points on the right and left in the center of the heat roller. In the second group, the separating pawls are disposed outside the separating pawls of the first group. In the third group, the separating pawls are disposed on both side ends of the heat roller. The separating pawls of the third group are pressed against the circumferential surface of the heat roller by a spring having an elastic force larger than that of the separating pawls of the first and second groups. An image forming area of the sheet is separated from the heat roller by the separating pawls of the first and second groups, which are biased by a force that is smaller than that of the separating pawls of the third group, so that the fused image can be prevented from being damaged by the separating pawls.

In another fusing unit of the related art, the separating pawls are disposed at five points along the circumferential surface of the heat roller. The five separating pawls are constructed by central separating pawls that are disposed at three points in the center of the heat roller and two side separating pawls that are disposed on both side ends of the heat roller. Although the central separating pawls are substantially identical to the separating pawls in a basic configuration, the central separating pawls differs from the separating pawls in a structure of a rear end portion of a guide surface that is continuously provided adjacent to a tip end of the separating pawl. The rear end portion of the guide surface of the central separating pawl is drawn from the rear end portion of the guide surface of the side separating pawl with respect to the sheet. Therefore, the central separating pawl is prevented from providing a large frictional force, and generation of a streak flaw can be prevented in the central portion in a width direction of the sheet.

In still another fusing unit of the related art, the sheet is guided toward a sheet discharge guide by a rotatable guide provided in the separating pawl. The rotatable guide is constructed by a sprocket.

Generally, five or six separating pawls are provided in the fusing unit of the image forming apparatus of the related art, and the post-fusing sheet can stably be fed toward the sheet discharge guide near an exit roller because the sheet can be guided by more separating pawls as a sheet size is enlarged. There is no problem in a finishing state of the post-fusing sheet. However, in the case of a small-size sheet such as a postcard, because the sheet is guided by one or two separating pawls provided in the center in the circumferential surface of the heat roller, a large pressure is applied to the sheet, and sometimes a problem is generated in the finishing of the post-fusing sheet.

Particularly, in the case that a feed path is largely flexed between a nip portion of the fusing unit and the sheet discharge guide, a portion of a length in a feed direction of the small-size sheet such as the postcard is flexed, and thus, a sheet plane is not free from application of a large amount of pressure. In the case that the sheet is guided while an orientation of the sheet is changed by the sprocket provided in the separating pawl, because the pressure applied to the sheet plane is concentrated, a broken-line pattern matched with a pitch of the teeth of the sprocket is formed in a rear surface of the sheet, thereby degrading the finishing state of the sheet.

For example, when the central separating pawl that separates the small-size sheet is eliminated, the pressure applied to the sheet plane can be reduced to relax a sheet feeding condition, and the same finishing state as the large-size sheet is obtained. However, in fusing a thin and weak sheet, it is difficult to stably feed the sheet, and there is generated a new problem in that a corner portion at a start end edge in the feed direction of the sheet is folded or a wrinkle.

SUMMARY OF THE INVENTION

In order to overcome the problems described above, preferred embodiments of the present invention provide a fusing unit for an image forming apparatus, which can relax a small-size sheet feeding condition to improve a finishing state of the small-size sheet to the same degree as a large-size sheet and stably feed a thin and weak sheet.

A fusing unit for an image forming apparatus according to a preferred embodiment includes a heat roller and a press roller, which fuse a toner image to a recording sheet. The fusing unit also includes a plurality of separating pawls that are disposed to come into contact with a circumferential surface of the heat roller in order to separate the recording sheet from the heat roller. The separating pawls are disposed at predetermined points in a front and rear direction that corresponds to an axial direction of the heat roller. Rotatable guides that guide the recording sheet passing through a nip portion of the fusing unit to a sheet discharge guide of an exit feed path while an orientation of the recording sheet is changed is provided in each of the separating pawls. In a fusing feed path from the nip portion of the fusing unit to the sheet discharge guide through the rotatable guides, a flexion angle of a central feed path that passes by the rotatable guide of the first separating pawl disposed in the axial direction of the heat roller is larger than a flexion angle of a lateral feed path that passes by the second rotatable guide of the second separating pawl disposed in the axial direction of the heat roller.

Specifically, assuming that a triangle is defined by the lateral feed path and a straight line connecting the nip portion of the fusing unit and an introduction start end of the sheet discharge guide, a position in which the recording sheet is in contact with the first rotatable guide of the first separating pawl disposed in the axial direction of the heat roller is located inside a vertex of the triangle.

The sheet discharge guide includes a central sheet discharge guide that is provided opposite a central area in a width direction of the exit feed path and a lateral sheet discharge guide that is provided opposite an area near the central area. Assuming that a triangle is defined by the lateral feed path and a straight line connecting the nip portion of the fusing unit and an introduction start end of the lateral sheet discharge guide, an introduction start end of the central sheet discharge guide is located outside an oblique-side portion on a side of the lateral sheet discharge guide of the triangle.

In the present preferred embodiment, the flexion angle of the central feed path through which the minimum-size sheet is fed is preferably larger than the flexion angle of the lateral feed path through which the larger-size sheet is fed, so that the degree of the curvature of the minimum-size sheet can be reduced during feeding the minimum-size sheet. Therefore, the minimum-size sheet feeding condition can be relaxed to reduce the pressure applied to the sheet plane, and the same finishing state as the large-size sheet is obtained. Particularly, in a case in which the minimum-size sheet is guided while deflected by the first sprocket provided with teeth, a flexion reactive force of the teeth acting on the sheet plane of the small-size sheet can be significantly reduced and minimized to eliminate the formation of the broken-line pattern matched with the pitch of the teeth in the rear surface of the sheet. Even in fusing the thin and weak sheet, a feed surface of the sheet can stably be guided toward the sheet discharge guide while being deflected by the rotatable guides of the plural separating pawls. Accordingly, the deformations of the sheet plane such as the folding of the corner portion at the start end edge in the feed direction of the sheet and the generation of the wrinkle in the sheet plane, which are caused by the feeding failure, are not generated.

When the position in which the recording sheet is in contact with the first rotatable guide of the first separating pawl is located inside the vertex of the triangle that is defined by the nip portion, the introduction start end, and the lateral feed path, the flexion angles can be separated from each other only by partially changing a structure of the fusing unit. Specifically, the flexion angles of the feed paths can be separated from each other only by changing a position of the central rotatable guide. Accordingly, the structure change that reduces the small-size sheet feeding condition is minimized, and a cost increase associated with the structural change can be reduced. Because the flexion angles of the feed paths can be separated from each other only by changing the position of the central rotatable guide, advantageously the present preferred embodiment can be applied to existing image forming apparatus.

When the introduction start end of the central sheet discharge guide is located outside the oblique-side portion on the side of the lateral sheet discharge guide of the triangle that is defined by the nip portion, the introduction start end, and the lateral feed path, the feed paths from the nip portion to the rotatable guides can be matched with each other. The same position in the feed direction of the sheet can be guided while deflected by the rotatable guides. Accordingly, the sheet can stably be fed from the nip portion to the rotatable guides, and particularly the thin and weak sheet can properly be fed. Therefore, deformations of the sheet plane such as folding of the corner portion at the start end edge in the feed direction of the sheet and the generation of the wrinkle in the sheet plane, which are caused by the feeding failure, can more securely be eliminated.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
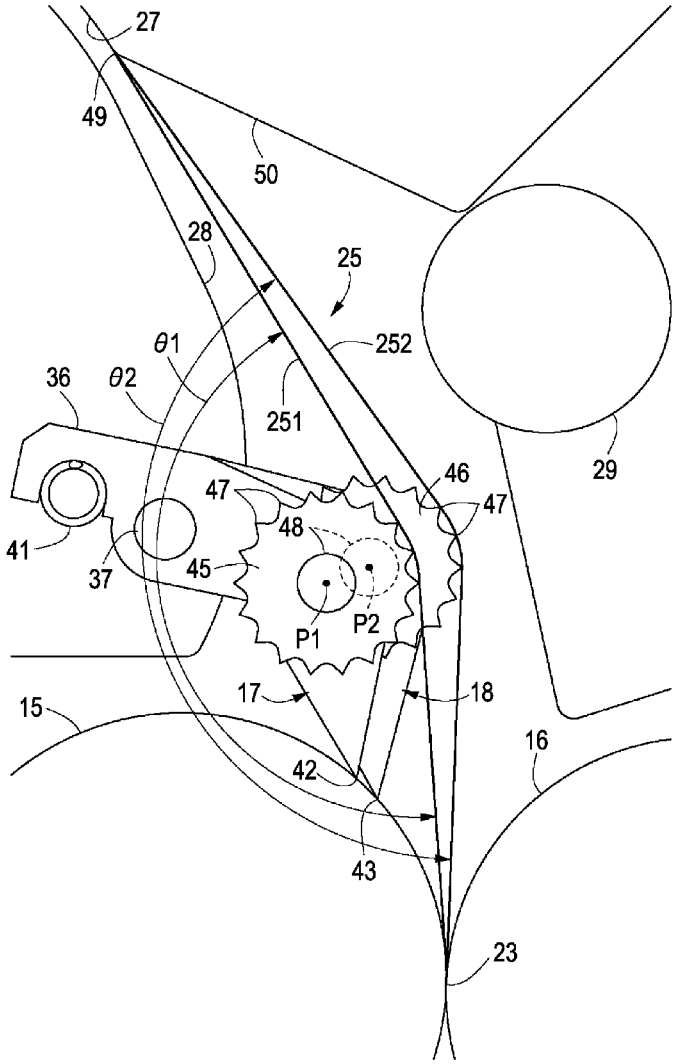
FIG. 1 is a view illustrating a principle of a fusing feed path in a fusing unit according to a first preferred embodiment of the present invention.

FIGS. 1 to 5 illustrate a fusing unit according to a first preferred embodiment of the present invention that is preferably applied to a multi-function peripheral (image forming apparatus) having a copy function and a facsimile function. In the drawings, front and rear, right and left, and up and down are subject to cross arrows illustrated in FIGS. 2 and 4 and signs of front and rear, right and left, and up and down expressed near the arrows.

Figure 2:
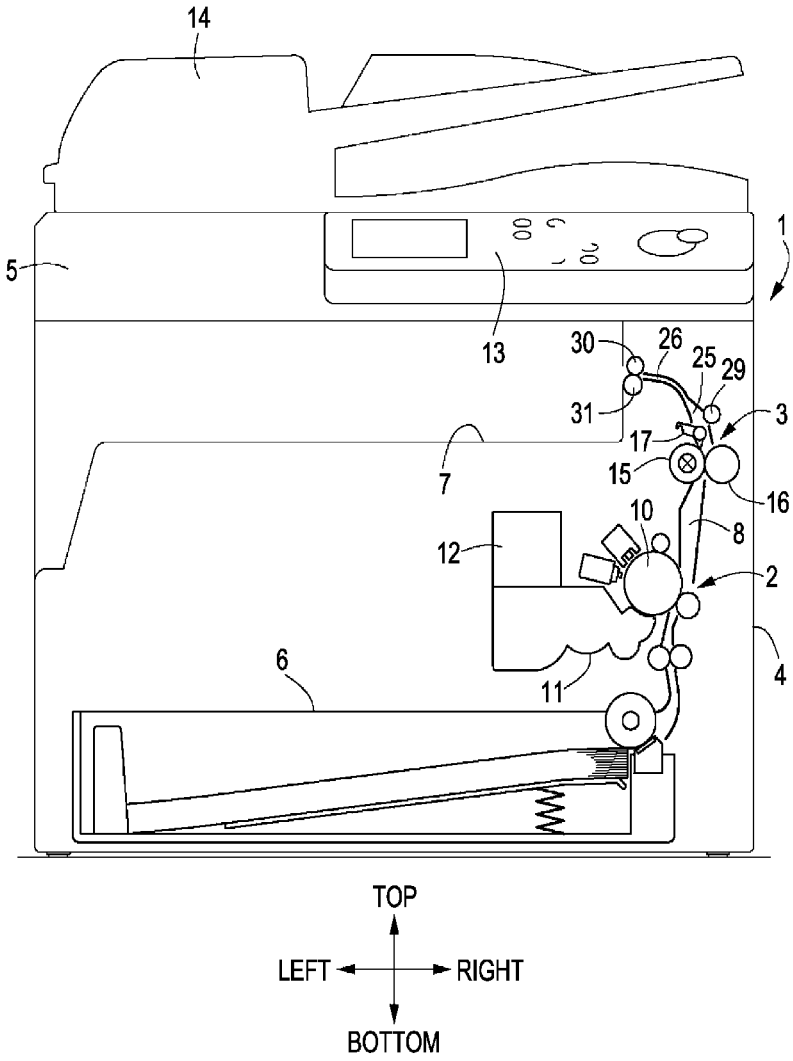
FIG. 2 is a schematic front view of an image forming apparatus.

Referring to FIG. 2, a multi-function peripheral 1 includes an image forming unit 2, a main body unit 4 in which a fusing unit 3 is disposed, and an image reader 5 that is located in an upper portion of the main body unit 4. In the multi-function peripheral 1, a sheet feed path 8 is provided between a paper cassette 6 disposed in a lower portion of the main body unit 4 and an exit unit 7 disposed in the upper portion of the main body unit 4. The image forming unit 2 is disposed below the feed path 8 while the fusing unit 3 is disposed above the feed path 8. Openings and covers that open and close the openings are provided in surrounding walls of the main body unit 4, which faces the fusing unit 3. Maintenance of the fusing unit 3 can be performed by opening the covers, and a paper jam can be released in the fusing unit 3 and the feed path 8 around the fusing unit 3.

The image forming unit 2 includes a developing unit 10, a photosensitive drum 11, and a toner cartridge 12, and forms an image by transferring a toner image to a sheet fed from the paper cassette 6. An operational panel 13 including various buttons is provided in a front surface of the image reader 5, and an Auto-Document Feeder (ADF) 14 is provided on an upper surface of the image reader 5. The images of a bundled document such as a book can be read while the bundled document is placed on a platen glass of the upper surface of the image reader 5, and a sheet-like document can be read by passing through the ADF 14.

Figure 3:
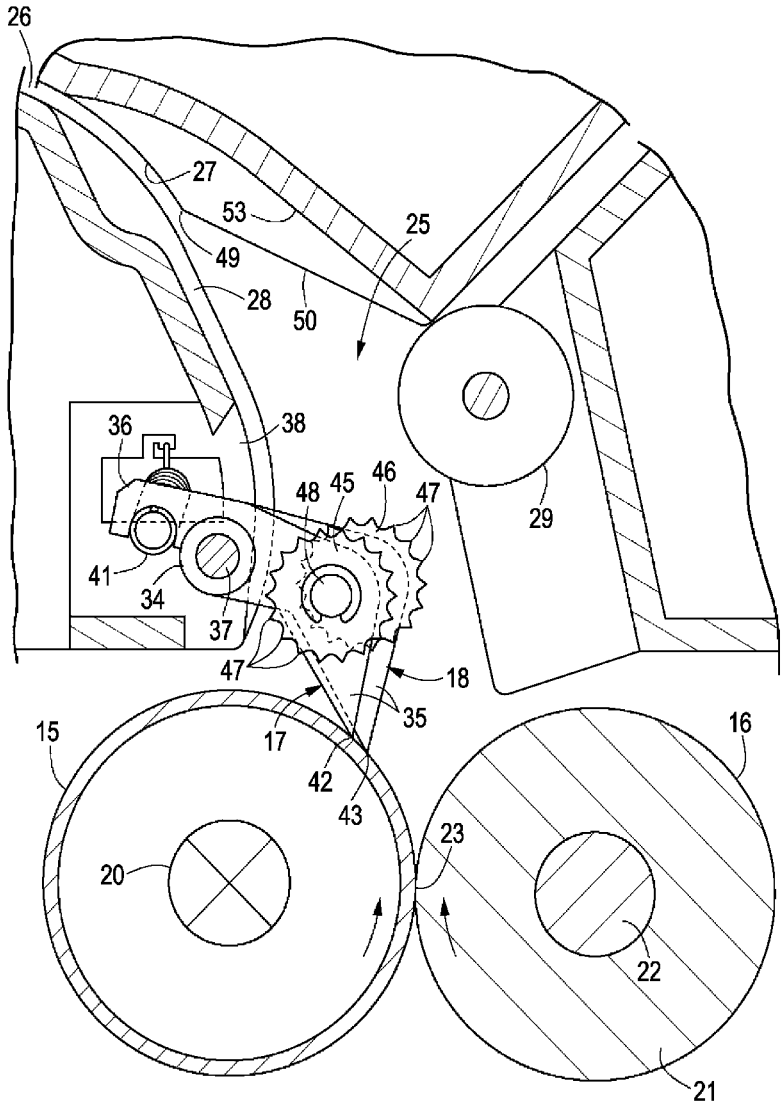
FIG. 3 is a vertical sectional view illustrating the fusing unit and a peripheral structure thereof.

Referring to FIG. 3, the fusing unit 3 includes a heat roller 15, a press roller 16 that is in contact with a circumferential surface of the heat roller 15, and a plurality of separating pawls 17 and 18 that circumscribe the circumferential surface of the heat roller 15. The heat roller 15 is preferably an aluminum-alloy tube, and a heater 20 is provided in the heat roller 15. Front and rear ends of the heat roller 15 are supported on bearings, and the heat roller 15 is rotated in a counterclockwise direction of FIG. 3 by a motor (not illustrated).

The press roller 16 includes a roll layer 21 that constitutes a majority of the press roller 16 and a roll axis 22 on which the roll layer 21 is supported. The roll layer 21 is preferably made of rubber or synthetic-resin foam. Vicinities of ends of the roll axis 22 are rotatably supported in a guide frame (not illustrated), the guide frame is guided while being able to reciprocate with respect to the heat roller 15, and the guide frame is pressed against the heat roller 15 by a press spring (not illustrated) constructed by a coil spring. The press roller 16 is brought into close contact with the heat roller 15 to define a sheet passing nip portion 23 between the rollers 15 and 16. The sheet on which the toner image is formed by the image forming unit 2 is caused to pass through the nip portion 23 to heat and pressurize the toner image, which allows the toner image to be fused on the sheet.

The sheet that passes through the nip portion 23 is fed to a fusing feed path 25 that is provided downstream from the fusing unit 3 and the exit unit 7 through an exit feed path 26. Sheet discharge guides 27 and 28 that include rib walls are provided above and below an introduction start end of the exit feed path 26, and a feed roller 29 is provided adjacent to an end portion on an upstream side of the upper sheet discharge guide 27. A pair of exit rollers 30 and 31 is disposed above and below the exit feed path 26. The feed roller 29 and exit roller 31 rotate to feed the sheet in a direction in which the sheet exits.

Figure 4:
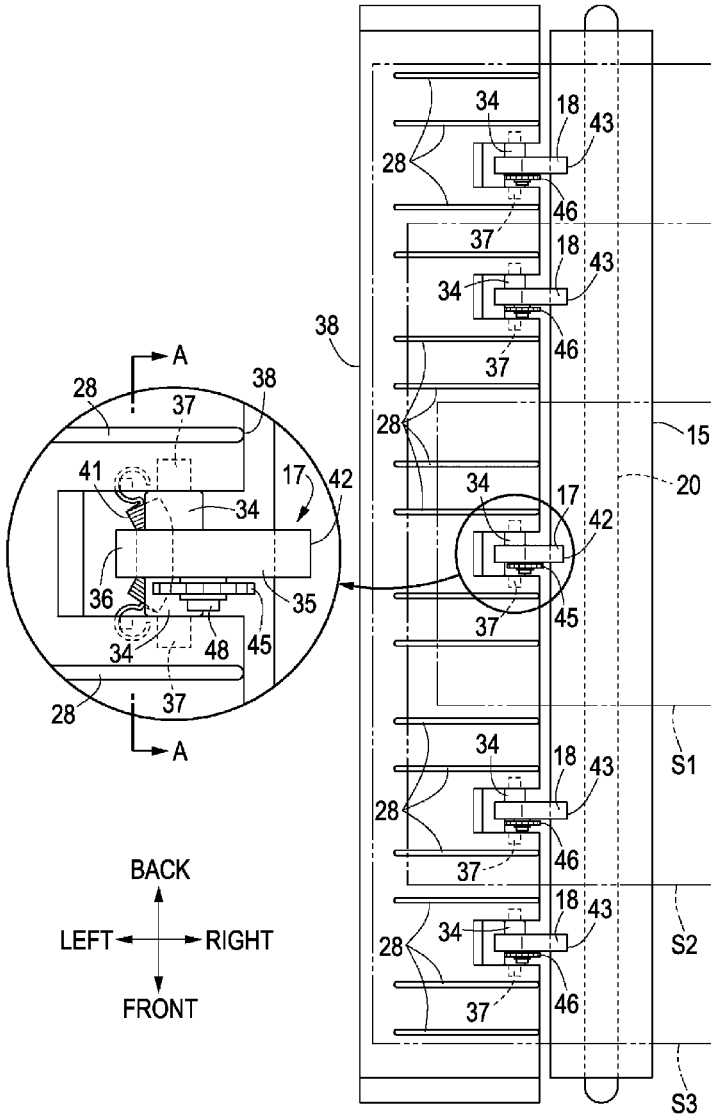
FIG. 4 is a plan view illustrating alignments of the fusing unit and a separating pawl.
Figure 5:
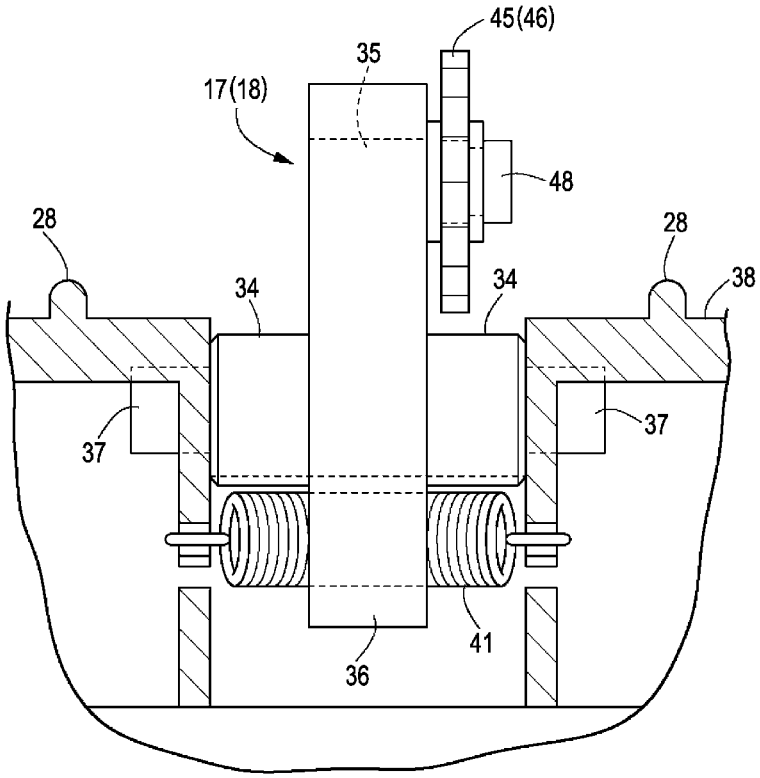
FIG. 5 is a sectional view taken on a line A-A of FIG. 4.

As illustrated in FIG. 4, the first separating pawl 17 and the second separating pawls 18 are disposed preferably at five points along the circumferential surface of the heat roller 15 in a front and rear direction. Particularly, one first separating pawl 17 is disposed in the center of the heat roller 15 in the front and rear direction (center axis direction), and each two of four second separating pawls 18 are provided on the front side and the rear side of the heat roller 15, respectively. As to the sheet that can be used in the multi-function peripheral 1 of the first preferred embodiment, the multi-function peripheral 1 can accommodate anything from a minimum postcard (100×148 mm) to an A3-sheet, a postcard-size sheet S1 is guided while separated by the central first separating pawl 17. A B5-size or A4-size sheet S2 is guided while being separated by the total of three separating pawls of the first separating pawl 17 and the second separating pawls 18 on the first separating pawl 17 and the front side and the rear side of the first separating pawl 17, and a B4-size or an A3-size sheet S3 are guided while being separated by the five separating pawls 17 and 18. FIG. 4 illustrates the state in which a short edge side of each of the sheets S1 to S3 is located above the first separating pawl 17 and the second separating pawl 18.

As illustrated in FIG. 3, the first separating pawl 17 and the second separating pawl 18 are constructed by plastic moldings each of which integrally includes a boss 34, a separating arm 35, and a spring receiver arm 36. Specifically, each of the separating pawls 17 and 18 includes the boss 34 that includes a rocking shaft 37 in the center in the right and left direction, the wedge-shaped separating arm 35 is obliquely arranged to extend from the boss 34 toward the circumferential surface of the heat roller 15, and the spring receiver arm 36 is provided on the other side of the boss 34. The rocking shaft 37 of each of the separating pawls 17 and 18 is supported in a pawl support frame 38 while being able to rock. At this point, a lower surface of the spring receiver arm 36 of each of the separating pawls 17 and 18 is biased upward by a coil spring 41, whereby pawl tips 42 and 43 of the separating arms 35 are brought into contact with the circumferential surface of the heat roller 15 as illustrated in FIG. 3. The center positions of the rocking shafts 37 of the separating pawls 17 and 18 are aligned with each other. The group of the sheet discharge guides 28 is provided in an outer surface of the pawl support frame 38 (see FIG. 4). Similarly the group of the upper sheet discharge guides 27 is provided in a guide wall 53 while facing the lower sheet discharge guides 28 (see FIG. 3).

A first sprocket (rotatable guide) 45 and second sprockets 46 are provided on the front surface side in an upper corner of the separating arm 35 in order that the sheet separated from the circumferential surface of the heat roller 15 is deflected and guided toward the sheet discharge guide 27 of the exit feed path 26. Each of the first sprocket 45 and the second sprockets 46 preferably includes a spur structure in which a group of teeth 47 is circumferentially arranged, and each of the first sprocket 45 and the second sprockets 46 is rotatably supported by a shaft 48 provided in the separating arm 35.

The fusing feed path 25 includes a feed path that reaches an introduction start end 49 of the upper sheet discharge guide 27 from the nip portion 23 through the first sprocket 45 and the second sprockets 46. In the first preferred embodiment, each of the separating pawls 17 and 18 is disposed such that the circumferential surface of each of the sprockets 45 and 46 projects toward the side of the feed roller 29 from a straight line connecting the nip portion 23 and the introduction start end 49, whereby the fusing feed path 25 is flexed into a reverse L-shape. A guide surface 50 that guides the sheet toward the introduction start end 49 is arranged to extend obliquely upward between the introduction start end 49 and the feed roller 29.

As described above, in the flexed fusing feed path 25, the small-size sheet is fed while largely curved along the surrounding of the first sprocket 45, and a large pressure is applied to a sheet plane. In order to reduce the pressure associated with the curvature, the central separating pawl 17 and the first sprocket 45 provided in the central separating pawl 17 are provided as follows. The separating arm 35 of the central separating pawl 17 is preferably smaller than that of the second separating pawl 18, and the pawl tip of the first separating pawl 17 is circumscribed on the circumferential surface of the heat roller 15 downstream from the pawl tip 43 of the second separating pawl 18 in the rotating direction of the heat roller 15. A rotation center P1 of the first sprocket 45 of the first separating pawl 17 is located closer to the rocking shaft 37 than a rotation center P2 of the second sprocket 46 of the second separating pawl 18.

As described above, the sprockets 45 and 46 differ from each other in the positions of the rotation centers P1 and P2, whereby the center and the front and rear ends of the heat roller 15 differ from each other in the flexion angle of the fusing feed path 25 as illustrated in FIG. 1. Particularly, a flexion angle θ2 of a lateral feed path 252 passing by the second sprockets 46 of the four second separating pawls 18, which are disposed in front and rear of the central first separating pawl 17, is preferably set to about 142 degrees, for example, when a flexion angle θ1 of a central feed path 251 passing by the first sprocket 45 of the central first separating pawl 17 is set to about 152 degrees, for example.

When the flexion angle θ1 of the central feed path 251 is smaller than the flexion angle θ2 of the lateral feed path 252, the large pressure applied to the sheet plane of postcard-size sheet fed along the central feed path 251 can be eliminated while the postcard-size sheet is prevented from being largely curved. That is, the small-size recording sheet feeding condition can be relaxed to reduce the strong action of the flexion reactive force, generated by the teeth 47 of the first sprocket 45, on the sheet plane of the small-size recording sheet. Accordingly, the formation of the broken-line pattern matched with the pitch of the teeth 47 can be eliminated on the rear surface of the sheet to obtain the same finishing state as the large-size sheet. In a case in which the thin and weak sheet is fused, the surface of the sheet can securely and stably be guided toward the sheet discharge guide 27 by the sprockets 45 and 46 of the five separating pawls 17 and 18. Therefore, the deformations of the sheet plane such as the folding of the corner portion at the start end edge in the feed direction of the sheet and the generation of the wrinkle in the sheet plane, which are caused by the feeding failure, are not generated.

In this preferred embodiment, there is the following positional relationship between the first separating pawl 17 and the first sprocket 45, which are disposed in the center, and the lateral feed path 252. Assuming that a triangle is defined by the lateral feed path 252 and a straight line connecting the nip portion 23 of the fusing unit 3 and the introduction start end 49 of the sheet discharge guide 27, a partial arc position in which the sheet comes into contact with the sprocket 45 of the separating pawl 17 disposed in the central portion is located inside a vertex of the triangle. As used herein, the vertex of the triangle is a partial arc position in which the sheet comes into contact with the sprockets 46 of the separating pawls 18 disposed in the front and rear of the heat roller 15.

Figure 6:
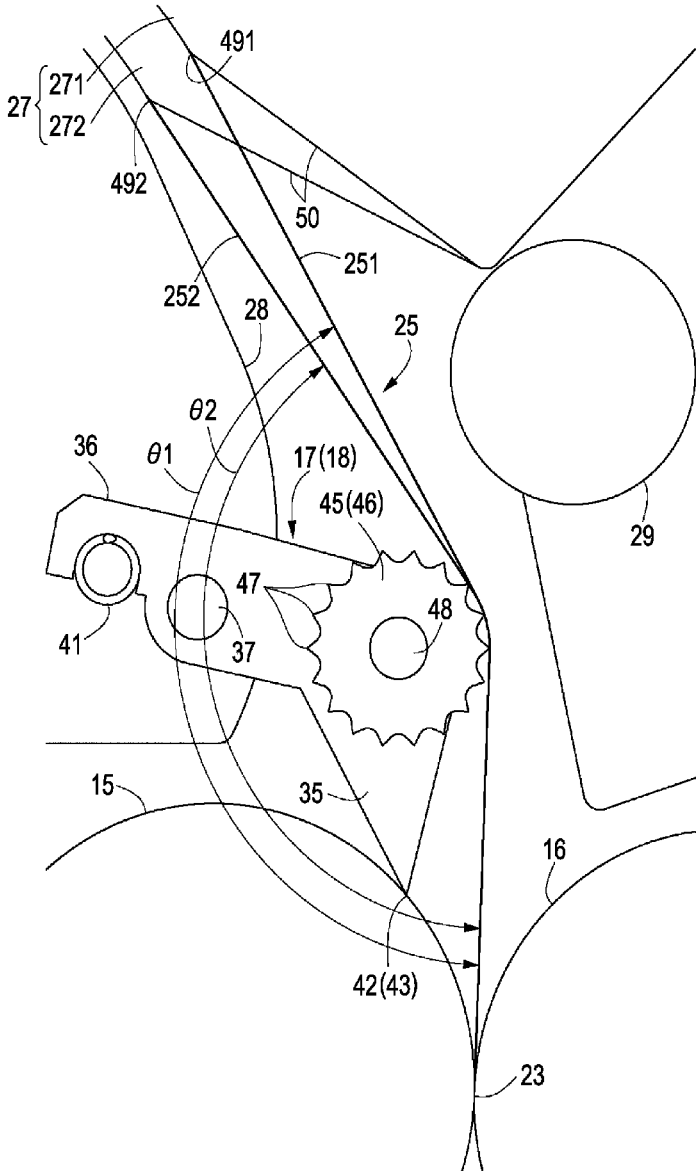
FIG. 6 is a view illustrating a principle of a fusing feed path according to a second preferred embodiment of the present invention.
Figure 7:
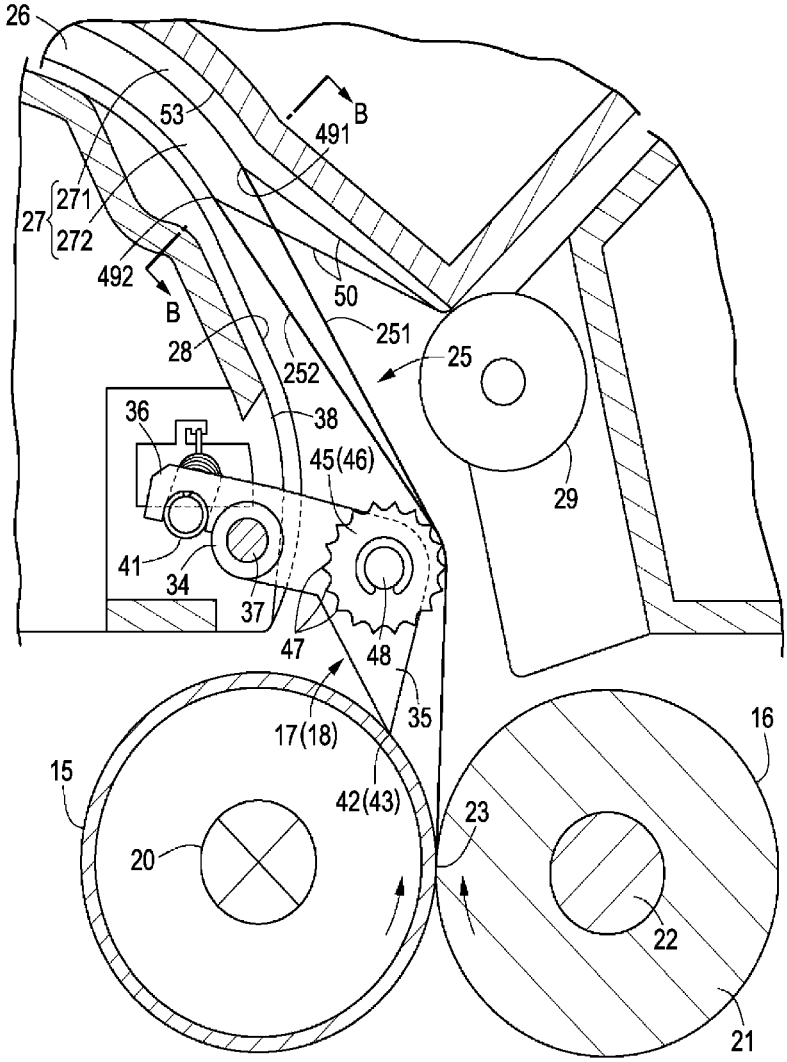
FIG. 7 is a vertical sectional view illustrating the fusing unit of the second preferred embodiment of the present invention and a peripheral structure thereof.
Figure 8:
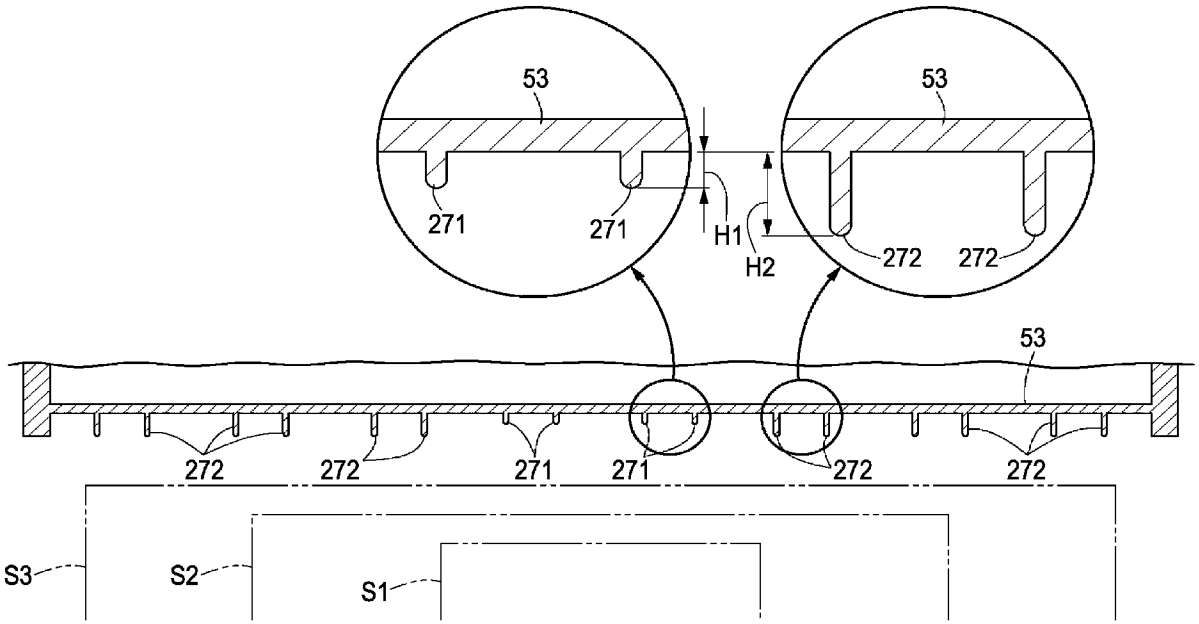
FIG. 8 is a sectional view taken on a line B-B of FIG. 7.

In the above-described preferred embodiment, the rotation center P1 of the first sprocket 45 of the first separating pawl 17 located in the center of the heat roller 15 is shifted toward the side of the rocking shaft 37, whereby the flexion angles θ1 and θ2 of the central feed path 251 and the lateral feed path 252 differ from each other. However, this is not necessary. As illustrated in FIGS. 6 to 8, the central feed path 251 differs from the lateral feed path 252 in the position of the sheet discharge guide 27, the flexion angles θ1 and θ2 of the feed paths 251 and 252 may differ from each other by separating the position of the sheet discharge guide 27 of the central feed path 251 from the position of the sheet discharge guide 27 of the lateral feed path 252.

Particularly, as illustrated in FIG. 6, the rib-shaped sheet discharge guide 27 provided in the guide wall 53 includes four central sheet discharge guides 271 provided opposite a central area in the width direction of the exit feed path 26 and a group of lateral sheet discharge guides 272 provided in areas in the front and rear of the central area. Additionally, as illustrated in FIG. 8, a projection length H1 from the guide wall 53 of the central sheet discharge guide 271 is preferably smaller than a projection length H2 from the guide wall 53 of the lateral sheet discharge guide 272. Therefore, a position of an introduction start end 491 of the central sheet discharge guide 271 is brought closer onto the side of the guide wall 53 than a position of an introduction start end 491 of the lateral sheet discharge guide 272, and the flexion angle θ1 of the central feed path 251 can be increased larger than the flexion angle θ1 of the lateral feed path 252. In this preferred embodiment, the flexion angle θ1 preferably is about 148 degrees, and the flexion angle θ2 preferably is about 142 degrees, for example.

In this preferred embodiment, the central separating pawl 17 is identical to the front and rear separating pawls 18 except the central separating pawl 17 in a shape and a size, the sprockets 45 and 46 provided in the separating pawls 17 and 18 are identical to each other in a center position. The postcard-size sheet can pass through the areas where the central sheet discharge guides 271 are provided, and the sheet having the size larger than the postcard-size sheet can pass through the areas where the lateral sheet discharge guides 272 are provided (see FIG. 8). Because other configurations of the second preferred embodiment are preferably identical to those of the first preferred embodiment, the same component is designated by the same numeral, and the description thereof is omitted.

In the preferred embodiment of FIGS. 6 to 8, a relationship between the central sheet discharge guide 271 and the lateral sheet discharge guide 272 is as follows. Assuming that a triangle is defined by the lateral feed path 252 and a straight line connecting the nip portion 23 of the fusing unit 3 and the introduction start end 492 of the sheet discharge guide 272, the introduction start end 491 of the central sheet discharge guide 271 is located outside an oblique-side portion on the side of the lateral sheet discharge guide 272 of the triangle.

In the preferred embodiments, the sprockets 45 and 46 are preferably used as the rotatable guide by way of example. Alternatively, the rotatable guide may be constructed by a roller in which a knurling is located in a circumferential surface thereof or a fan-wheel-shaped rotating body of a centrifugal fan. It is not necessary that one central separating pawl 17 and one sprocket 45 be disposed opposite the central feed path 251, but two or three central separating pawls 17 and two or three sprockets 45 may be disposed.

Alternatively, the rotation center P1 and P2 of the sprockets 45 and 46 are separated from each other, and the positions of the sheet discharge guide 271 and 272 of the central feed path 251 and the lateral feed path 252 are separated from each other, whereby the flexion angles θ1 and θ2 of the feed paths 251 and 252 may be separated from each other. Alternatively, a diameter of the sprocket 45 provided in the central separating pawl 17 is preferably set larger than diameters of the sprockets 46 provided in the front and rear separating pawls 18, and the whereby the flexion angles θ1 and θ2 of the feed paths 251 and 252 may be separated from each other. The rotation centers P1 and P2 of the sprockets 45 and 46 may be located on an arc that is coaxial with the heat roller 15.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. A fusing unit for an image forming apparatus, the fusing unit comprising:

a heat roller and a press roller, which fuse a toner image fused to a recording sheet;

a first separating pawl that is disposed to come into contact with a circumferential surface of the heat roller and separates the recording sheet from the heat roller;

a plurality of second separating pawls that are disposed with a spacing from the first separating pawl in an axial direction to come into contact with the circumferential surface of the heat roller and separate the recording sheet from the heat roller;

a first rotatable guide that is provided in the first separating pawl and guides the recording sheet passing through a nip portion of the fusing unit to a sheet discharge guide of an exit feed path while an orientation of the recording sheet is changed;

a second rotatable guide that is provided in each of the second separating pawls and guides the recording sheet passing through the nip portion of the fusing unit to the sheet discharge guide of the exit feed path while the orientation of the recording sheet is changed; and a fusing feed path that reaches the sheet discharge guide from the nip portion through the first rotatable guide and the second rotatable guide; wherein in the fusing feed path, a flexion angle of a central feed path that passes by the first rotatable guide of the first separating pawl disposed in a central portion in the axial direction of the heat roller is larger than a flexion angle of a lateral feed path that passes by the second rotatable guide of the second separating pawl disposed in the axial direction of the heat roller; and assuming that a triangle is defined by the lateral feed path and a straight line connecting the nip portion of the fusing unit and an introduction end of the sheet discharge guide, a position in which the recording sheet is in contact with the rotatable guide of the first separating pawl disposed in the axial direction of the heat roller is located inside a vertex of the triangle.

2. The fusing unit for the image forming apparatus according to claim 1, further comprising:

a separating arm that is provided in the separating pawl;

a spring receiver arm that is provided in the separating pawl; and a rocking shaft in which the separating pawl is supported in a pawl support frame while being able to rock.

3. The fusing unit for the image forming apparatus according to claim 2, further comprising a coil spring that biases the spring receiver arm, wherein a tip end of the separating arm comes into contact with the heat roller due to action of the coil spring.

4. The fusing unit for the image forming apparatus according to claim 1, wherein the first rotatable guide and the second rotatable guide include sprockets having teeth that come into contact with the recording sheet.

5. A fusing unit for an image forming apparatus, the fusing unit comprising:

a heat roller and a press roller, which fuse a toner image fused to a recording sheet;

a first separating pawl that is disposed to come into contact with a circumferential surface of the heat roller and separates the recording sheet from the heat roller;

a plurality of second separating pawls that are disposed with a spacing from the first separating pawl in an axial direction to come into contact with the circumferential surface of the heat roller and separate the recording sheet from the heat roller;

a first rotatable guide that is provided in the first separating pawl and guides the recording sheet passing through a nip portion of the fusing unit to a sheet discharge guide of an exit feed path while an orientation of the recording sheet is changed;

a second rotatable guide that is provided in each of the second separating pawls and guides the recording sheet passing through the nip portion of the fusing unit to the sheet discharge guide of the exit feed path while the orientation of the recording sheet is changed; and a fusing feed path that reaches the sheet discharge guide from the nip portion through the first rotatable guide and the second rotatable guide; wherein in the fusing feed path, a flexion angle of a central feed path that passes by the first rotatable guide of the first separating pawl disposed in a central portion in the axial direction of the heat roller is larger than a flexion angle of a lateral feed path that passes by the second rotatable guide of the second separating pawl disposed in the axial direction of the heat roller;

the sheet discharge guide includes a central sheet discharge guide that is opposite to a central area in a width direction of the exit feed path and a lateral sheet discharge guide that is opposite an area near the central area; and assuming that a triangle is defined by the lateral feed path and a straight line connecting the nip portion of the fusing unit and an introduction start end of the lateral sheet discharge guide, an introduction start end of the central sheet discharge guide is located outside an oblique-side portion on a side of the lateral sheet discharge guide of the triangle.

6. The fusing unit for the image forming apparatus according to claim 5, further comprising:

a separating arm that is provided in the separating pawl;

a spring receiver arm that is provided in the separating pawl; and a rocking shaft in which the separating pawl is supported in a pawl support frame while being able to rock.

7. The fusing unit for the image forming apparatus according to claim 6, further comprising a coil spring that biases the spring receiver arm, wherein a tip end of the separating arm comes into contact with the heat roller due to action of the coil spring.

8. The fusing unit for the image forming apparatus according to claim 5, wherein the first rotatable guide and the second rotatable guide include sprockets having teeth that come into contact with the recording sheet.

* * * * *